US005238672A

United States Patent [19]

Sumner et al.

[11] Patent Number: 5,238,672

[45] Date of Patent: Aug. 24, 1993

[54] MESOPHASE PITCHES, CARBON FIBER PRECURSORS, AND CARBONIZED FIBERS

[75] Inventors: Michael B. Sumner, Ceredo, W. Va.; William P. Hettinger, Russell, Ky.

[73] Assignee: Ashland Oil, Inc., Ashland, Ky.

[21] Appl. No.: 369,442

[22] Filed: Jun. 20, 1989

[51] Int. Cl.[5] ..... D01F 9/12; C10C 3/02

[52] U.S. Cl. ..... 423/447.4; 423/447.7; 208/39; 208/44; 264/292; 264/83

[58] Field of Search ..... 423/447.4, 447.7; 427/113; 208/39, 44; 264/29.2, 83

[56] References Cited

U.S. PATENT DOCUMENTS

| | | | |
|---|---|---|---|
| 2,768,119 | 10/1956 | Nash | 196/14.11 |
| 2,871,181 | 1/1959 | Kulik | 208/45 |
| 3,093,573 | 6/1963 | Corbett | 208/39 |
| 3,140,248 | 7/1964 | Bell et al. | 208/40 |
| 3,348,600 | 10/1967 | Monty | 159/6 |
| 3,349,828 | 10/1967 | Monty | 159/6 |
| 3,392,216 | 7/1968 | Otani | 264/29 |
| 3,595,946 | 7/1971 | Jon et al. | 264/29 |
| 3,629,379 | 12/1971 | Otani | 264/29 |
| 3,702,054 | 11/1972 | Oraki et al. | 57/157 |
| 3,718,493 | 2/1973 | Jon et al. | 106/273 |
| 3,767,741 | 10/1973 | Toyogache | 264/29 |
| 3,801,342 | 4/1974 | Berber et al. | 106/284 |
| 3,825,380 | 7/1974 | Harding et al. | 425/72 |
| 3,849,241 | 11/1974 | Butin et al. | 161/169 |
| 3,882,077 | 5/1975 | Takita et al. | 260/37 |
| 3,895,084 | 7/1975 | Bauer | 264/29 |
| 3,919,376 | 11/1975 | Schulz | 264/102 |
| 3,954,361 | 5/1976 | Page | 425/72 |
| 3,966,887 | 6/1976 | Chicke | 423/447 |
| 3,974,264 | 8/1976 | McHenry | 423/447.4 |
| 3,976,729 | 8/1976 | Lewis et al. | 264/29.7 |
| 3,978,185 | 8/1976 | Buntin et al. | 264/93 |
| 3,995,014 | 11/1976 | Lewis | 423/447.4 |
| 4,005,183 | 1/1977 | Singer | 423/447.2 |
| 4,017,327 | 4/1977 | Lewis et al. | 106/273 |
| 4,020,145 | 4/1977 | Soehngen et al. | 423/447.4 |
| 4,026,788 | 3/1977 | McHenry | 208/39 |
| 4,032,607 | 6/1977 | Schulze | 264/29.3 |
| 4,046,525 | 9/1977 | Matsuo et al. | 55/59 |
| 4,055,583 | 10/1977 | Kolling et al. | 423/447.4 |
| 4,080,283 | 3/1978 | Noguchi et al. | 208/40 |
| 4,115,527 | 9/1978 | Otani et al. | 423/447.4 |
| 4,138,525 | 2/1979 | Schulz | 428/367 |
| 4,184,942 | 1/1980 | Angier et al. | 208/44 |
| 4,197,282 | 4/1980 | Bailly-Lacresse et al. | 423/447.4 |
| 4,197,283 | 4/1980 | Crepany et al. | 423/474.4 |
| 4,208,267 | 6/1980 | Diefendorf et al. | 208/22 |
| 4,209,500 | 6/1980 | Chwastiak | 423/447.6 |
| 4,219,404 | 8/1980 | Dickakian | 208/39 |
| 4,243,512 | 1/1981 | Seo | 208/39 |
| 4,265,727 | 5/1981 | Beckley | 204/242 |
| 4,265,869 | 5/1981 | Kaji et al. | 423/447.4 |
| 4,271,006 | 6/1981 | Dickakian | 208/40 |
| 4,272,501 | 6/1981 | Greskovich et al. | 423/447.1 |
| 4,275,051 | 6/1981 | Barr | 423/447.4 |
| 4,275,095 | 6/1981 | Warren | 427/228 |
| 4,277,324 | 7/1981 | Greenwood | 208/45 |

(List continued on next page.)

FOREIGN PATENT DOCUMENTS

| | | |
|---|---|---|
| 0021708 | 6/1980 | European Pat. Off. . |
| 0054437 | 12/1981 | European Pat. Off. . |
| 0084237 | 7/1983 | European Pat. Off. . |

(List continued on next page.)

OTHER PUBLICATIONS

"The Use of Cinematography in a Study of Mesophase Formation" by D. S. Hooever, et al., presented at 14th Biennial Conference on-Carbon-Extended Abstracts &

(List continued on next page.)

*Primary Examiner*—Peter A. Nelson
*Attorney, Agent, or Firm*—Richard C. Willson, Jr.; Stanley M. Welsh

[57] ABSTRACT

Producing carbon fiber precursors and carbonized fibers comprise by treating a thin film of catalytic pitch at elevated temperature conditions, treating the resulting heavy isotropic pitch by agitating with an inert gas under elevated temperature conditions to form a mesophase pitch, forming green fibers from said mesophase pitch, stabilizing and optionally carbonizing said green fibers to obtain the desired product.

13 Claims, 3 Drawing Sheets

U.S. PATENT DOCUMENTS

| | | | |
|---|---|---|---|
| 4,277,325 | 7/1981 | Greenwood | 208/45 |
| 4,283,269 | 8/1981 | Greenwood | 208/45 |
| 4,297,307 | 10/1981 | Taylor | 264/29.5 |
| 4,303,631 | 12/1981 | Lewis et al. | 423/447.1 |
| 4,314,981 | 2/1982 | Miyanori et al. | 423/447.1 |
| 4,317,809 | 3/1982 | Lewis et al. | 423/447.1 |
| 4,320,107 | 3/1982 | Oyabu et al. | 423/447.6 |
| 4,331,620 | 5/1982 | Diefendorf et al. | 264/29.2 |
| 4,351,816 | 9/1982 | Schulz | 423/447.4 |
| 4,369,171 | 1/1983 | Grindstaff et al. | 423/461 |
| 4,389,387 | 6/1983 | Miyamori et al. | 423/447.7 |
| 4,397,401 | 8/1983 | Ueno et al. | 220/260 |
| 4,402,928 | 9/1983 | Lewis et al. | 423/447.1 |
| 4,424,145 | 1/1984 | Sara | 252/509 |
| 4,427,530 | 1/1984 | Dickakiar | 208/22 |
| 4,431,623 | 2/1984 | Tug | 423/447.1 |
| 4,457,967 | 7/1984 | Chareire | 428/212 |
| 4,460,454 | 7/1984 | Iijima et al. | 208/40 |
| 4,460,557 | 7/1984 | Takashima et al. | 423/447.1 |
| 4,462,893 | 7/1984 | Moriya et al. | 208/40 |
| 4,465,586 | 8/1984 | Diefendorf et al. | 208/45 |
| 4,469,667 | 9/1984 | Uemura et al. | 423/447.1 |
| 4,470,960 | 9/1984 | Uemura et al. | 423/447.1 |
| 4,472,265 | 9/1984 | Otani | 208/22 |
| 4,474,617 | 10/1984 | Uemura et al. | 208/22 |
| 4,497,789 | 2/1985 | Sauran et al. | 208/40 |
| 4,503,026 | 3/1985 | Dickakian | 423/447.4 |
| 4,504,455 | 3/1985 | Otani et al. | 423/447.6 |
| 4,506,028 | 3/1985 | Fukuda et al. | 502/101 |
| 4,518,482 | 5/1985 | Dickakian | 208/22 |
| 4,518,483 | 5/1985 | Dickakian | 208/44 |
| 4,522,701 | 6/1985 | Dickakian | 208/40 |
| 4,528,087 | 7/1985 | Shibatani et al. | 208/22 |
| 4,529,498 | 7/1985 | Watanabe | 208/44 |
| 4,529,499 | 7/1985 | Watanabe | 208/44 |
| 4,534,920 | 8/1985 | Yoshinaga et al. | 264/29.2 |
| 4,534,950 | 8/1985 | Uemura et al. | 423/447.4 |
| 4,548,704 | 10/1985 | Dickakian | 208/22 |
| 4,551,225 | 11/1985 | Dickakian | 208/43 |
| 4,554,148 | 11/1985 | Gomi et al. | 423/447.1 |
| 4,915,926 | 4/1990 | Lahijani | 423/447.4 X |
| 4,975,262 | 12/1990 | Suto et al. | 423/447.8 X |
| 4,986,943 | 1/1991 | Sheaffer et al. | 423/447.4 X |
| 4,990,285 | 2/1991 | Lahijani | 423/447.4 X |
| 4,996,037 | 2/1991 | Berkebile et al. | 208/44 X |
| 4,999,099 | 3/1991 | Fu et al. | 208/44 X |
| 5,061,413 | 10/1991 | Uemura et al. | 264/29.2 |

FOREIGN PATENT DOCUMENTS

| | | |
|---|---|---|
| 850880 | 9/1958 | United Kingdom . |
| 1307392 | 2/1976 | United Kingdom . |
| 2024248 | 6/1979 | United Kingdom . |
| 2109001 | 10/1982 | United Kingdom . |

OTHER PUBLICATIONS

Program. Jun. 25 to 29, 1979, Pennsylvania State University, pp. 393–394.

"Mesophase Formation in the Pyrolysis of Solvent--Fractionated Pitch" b V. L. Weinberg et al., presented at 15th Biennial Conf. on Carbon-Extended Abstracts & Program, Jun. 22 to 26, 1981, Pennsylvania, pp. 144–18.

"The Effect of Shear on Mesophase Formation in Ashland A-240 Pitch" by I. W. Sorensen et al., presented at the 16th Biennial Conf. on Carbon-Extended Abstracts & Program, Jul. 18 to 22, 1983, Univ. of California, San Diego, Calif. pp. 46–47, 74–75, and 96–97.

"DSC Studies of the Progress of Mesophase Formation" by P. Tlomak et al. presented at 19th Biennial Conf. on Carbon-Extended Abstracts & Program, Jun. 25 to 30, 1989, Penn State Univ. Park Campus pp. 112–113.

"Carbon-Carbon The Hotter the Better", High Technology, Sep. 1986, p. 55.

"Mesophase Stabilization by Oxidation Processing" by J. L. White et al. The Aerospace Corporation, Los Angeles, Calif.

"Novel Mesophase Pitch", Mitsubishi Gas Chemical Company, Inc. Tokyo, Japan, Mar. 1990.

"Kurcha Carbon Fiber", Kurcha Chemical Industry Co., Ltd., Tokyo, Japan.

"Aerocarb carbon matrix material", Ashiand Petroleum Company, Oakland, Ky.

"Kurcha Business Activities", Kurcha Chemical Industry Co. Ltd.

"Eureka Process", Kureha Chemical Co., Ltd., Chiyoda Chemical Engineering & Construction Co., Ltd.

"Plastics in the USAT: Past, Present & Future" by R. K. Sauer, Colonel & USAF-Wright Patterson AForce Base, Lit.

"Develop & Commercialization of the Melt Blowing Process for Many of Fine Fibered Webs" by D. O. Bringman of Bright Corp. . . . of Exxon.

"The Processing & Properties of High Temp. Resistant Poly-bismaleimide Carbon Fiber Laminant" by H. Petrouicki, H. D. Stenyenberger & A. Van Harnier.

"Commerical Graphite Fiber Debut" by Plastics World Nov. 19, 1973.

"Coming Cut Rate Super Fibers" by Modern Plastics.

"RP/C Appl. in '74 Model Automobile," by R. J. Savage.

"Jun. 1970 Process Engineer Newsforces", p. 7.

"New Materials", p. 26, Modern Plastics Oct. 1973.

"Chemical Changes During the Mild Air Oxidation of Pitch" by J. B. Barr & I. C. Lewis, Union Carbide.

"Analysis of Flows in High Strength Carbon Fibers from Mesophase Pitch" by J. B. Jones, J. B. Barr & R. E. Smith, Union Carbide Corp.

NOTE: S.P. = SOFTENING POINT

MESOPHASE PITCHES, CARBON FIBER PRECURSORS, AND CARBONIZED FIBERS

BACKGROUND OF THE INVENTION

1. Field of the Invention

This invention relates to the formation of mesophase pitches useful for the production of carbonized fibers. More particularly, this invention relates to melt spinnable mesophase pitches that are suited to the production of pitch fibers.

2. Description of the Prior Art

Petroleum pitches with suitable softening points can be used satisfactorily as an impregnation material for electrodes, anodes, and carbon-carbon composites, e.g., carbon-carbon fiber composites, such as aircraft brakes and rocket engine nozzles. These pitches can also be used in the nuclear industry for the preparation of fuel sticks for a graphite moderated reactor. Furthermore, such pitches can be used in the production of carbon fiber precursors and carbonized fibers, i.e., carbon fibers and graphite fibers.

High strength per weight ratio of carbon and graphite fibers, alone or in composites, makes such fibers useful in sporting equipment, automobile parts, light-weight aircraft, and several aerospace applications.

U.S. Pat. Nos. 4,497,789 and 4,671,864, of Sawran et al., discloses producing substantially non-mesophasic pitch with a wiped-film evaporator.

U.S. Pat. Nos. 3,974,264 and 4,026,788, of McHenry disclose producing carbon fibers from pitch. A non-thixotropic, spinnable mesophase pitch having a mesophase content in the range of about 40 wt % to about 90 wt % is produced with shorter processing time by passing an inert gas through the pitch at a temperature in the range of 350° C. to 450° C.

U.S. Pat. Nos. 3,976,729 and 4,017,327, of Lewis, et al., disclose preparation of a non-thixotropic mesophase pitch while agitating the pitch during formation of the mesophase in order to produce a homogeneous emulsion of the immiscible mesophase and non-mesophase portions of the pitch. Improved rheological and spinning characteristics result from heating the pitch in an inert atmosphere at a temperature in the range of 380° C. to 440° C. for a time sufficient to produce a mesophase content in the range of 50 wt % to 65 wt % while agitating the pitch during the formation of the mesophase. A smaller differential between the average molecular weights of the mesophase and non-mesophase portions of the pitch also occurs.

U.S. Pat. No. 3,995,014 of Lewis discloses subjecting pitch to a reduced pressure during formation of the mesophase in order to substantially reduce the time otherwise required for its preparation.

U.S. Pat. No. 4,005,183 of Singer discloses a process for forming high-modulus, high-strength carbon fibers having a highly oriented structure containing crystallites. A mesophase-containing fiber is heated in an oxygen-containing atmosphere at 250° C. to 400° C. for a time sufficient to render it infusible, and then in an inert atmosphere to at least 1,000° C.

U.S. Pat. No. 4,080,283 of Noguchi, et al., discloses continuous production of pitch from a heavy hydrocarbon oil by mixing with an inactive gas, such as nitrogen or steam, and heating at a temperature between 350° C. to 500° C. serially in a plurality of reactors with a portion of the liquid output from at least one of the reactors being recirculated. The liquid output of the final reactor can be introduced into an after-treatment duct-shaped chamber with an inactive atmosphere sealed therewithin to cool said liquid output. Such operation provides uniformity of reaction conditions in the reactor system.

U.S. Pat. No. 4,184,942 of Angier, et al. discloses producing an optically anisotropic, deformable pitch from a carbonaceous isotropic pitch by initially heating at between 350° to 450° C. and then extracting with an organic solvent system. The solvent-insoluble fraction is convertable into an optically anisotropic pitch.

U.S. Pat. No. 4,208,267 of Diefendorf, et al. discloses producing an optically anisotropic, deformable pitch from the solvent-insoluble fraction of a carbonaceous isotropic pitch that has been extracted with an organic solvent, e.g. such as benzene or toluene. The solvent-insoluble fraction is heated for 10 minutes or less to temperatures between 230° C. to 400° C., to yield an optically anisotropic phase of greater than 75%. The phase contains less than about 25 wt % of substances unextractable with quinoline at 75° C.

U.S. Pat. No. 4,209,500, of Chwastiak discloses producing: both a single-phase, essentially 100% anisotropic mesophase pitch having number average molecular weight below 1000, a net pyridine insoluble content no greater than 60% by weight, a softening temperature no greater than 350° C., and a viscosity no greater than 200 poises at 380° C. and carbonaceous fibers therefrom. An inert gas is passed at a sufficient rate through an isotropic carbonaceous pitch while heating the pitch at between 380° C. to about 430° C. to agitate sufficiently to produce a homogeneous emulsion of the mesophase and to ensure removal of volatile low-molecular weight components. By "inert gas" is meant to be a gas which does not cause a significant change in the chemical nature of the pitch materials being contacted at the process conditions of temperature and pressure.

U.S. Pat. No. 4,402,928, of Lewis, et al. discloses producing a carbon fiber from precursor material such as ethylene tars, ethylene tar distillates, gas oils derived from petroleum refining, gas oils derived from petroleum coking, aromatic hydrocarbons, and coal tar distillates having at least 50% by weight which boils under about 300° C. and at least about 70% by weight which boils under 360° C. One of these precursor materials is heated in batches under pressure to obtain a pitch which is solvent extracted to obtain an 70% by weight or more mesophase portion. The insoluble mesophase portion can be converted into a carbon fiber.

U.S. Pat. No. 4,460,557 of Takashima et al., discloses producing carbon fibers by heating a starting pitch between 340° C. to 450° C. under a stream of inert gas, such as nitrogen, at up to atmospheric pressure, melt spinning the resulting material to form pitch fibers, infusibilizing, and then carbonizing or graphitizing.

U.S. Pat. No. 4,504,455, of Otani, et al., and European Patent application No. 813058930, Publication No. 0054437, of Otani each discloses a carbonaceous pitch comprising quinoline soluble dormant anisotropic hydrocarbon components that are partially hydrogenated mesophase portions of a mesophase pitch. The carbonaceous pitch is optically isotropic in nature with a dormant mesophase orientable when subjected to shear forces. The dormant mesophase pitch is prepared by hydrogenerating the mesophase of a mesophase pitch until substantially all the mesophase is quinoline soluble. Production of a carbon fiber from these pitches is also disclosed. In the European application, the dormant mesophase pitch is prepared by solvent extracting mesophase pitch into quinoline insolubles and quinoline solubles and then hydrotreating the quinoline insoluble portion. The higher the measured quinoline insoluble fraction, the higher tends to be the amount of mesophase components that are present.

U.S. Pat. No. 4,528,087, of Shibatani, et al., discloses producing, with for example extraction, a mesophase pitch containing 40% or more of quinoline solubles by heating a pitch having an aromatic hydrogen content of 50% to 90% at a temperature in the range of 430° C. to 550° C. while passing an inert gas thereover until at least 40% mesophase is formed.

U.S. Pat. No. 4,529,498, of Watanabe discloses producing a 100% mesophase pitch of quinoline-insoluble and quinoline-soluble components, by (1) heating to a temperature of 360° C. to 450° C. a petroleum derived pitch while stirring under a low molecular weight hydrocarbon gas atmosphere at atmospheric or superatmospheric pressure until the mesophase content is 10% to 50%, to form a heat treated pitch, (2) holding without stirring the heat treated pitch at a temperature in excess of 280° C., but below 350° C., to permit separation into a layer of non-mesophase and a layer of mesophase, and (3) separating the non-mesophase layer from the mesophase layer. High-strength, high-modulus carbon fibers can be produced from the resulting mesophase layer.

U.S. Pat. No. 4,529,499, of Watanabe adds to the method of U.S. Pat. No. 4,529,498 by subjecting separated non-mesophase material to steps (1), (2), and (3) at least 3 times to prepare a 100% mesophase composed only of quinoline-insoluble and quinoline-soluble components.

U.S. Pat. No. 4,575,411, of Uemura, et al., discloses producing a melt-spinnable carbon fiber precursor pitch with a softening point between 200° C. to 280° C. by heating a film of 5 mm or less of a carbonaceous pitch at a temperature of 250° to 390° C. and at a pressure of 100 mm mercury or less until the precursor pitch, contains 40% or more mesophase material. The mesophase pitch has 0 wt % to 15 wt % of an anisotropic quinoline-insoluble phase and 85 wt % to 100 wt % of an anisotropic quinoline-soluble phase.

Chwastiak's method of U.S. Pat. No. 4,209,500 involving stripping requires a relatively long time to obtain mesophase spinnable pitch from a base pitch. Not only is stripping time consuming, but also high-molecular weight materials can be carried over with low-molecular weight materials during stripping due to foaming and the like. However, even without foaming, the volatile carry over from stripping includes potentially useful components hard to recover due to the presence of highly diluting stripping gases and high cracked materials that increase with residence time at high temperatures.

The method of Diefendorf, et al., in U.S. Pat. No. 4,208,267 involves a solvent extraction to remove low-molecular weight component which is rather difficult to practice.

Carbonaceous materials (sometimes called fiber precursors) for the manufacture of carbon or high-strength graphite fibers, conventionally employ polyacrylonitrile or mesophase pitch. However, preparation of mesophase pitch requires a time consuming and expensive batch process of heating at an elevated temperature for a number of hours, as shown by Lewis, et al., in U.S. Pat. No. 3,967,729, by Singer, in U.S. Pat. No. 4,005,183, and by Schulz, in U.S. Pat. No. 4,014,725. Improper heating can increase viscosity of mesophase pitch too much, rendering it unsuitable for spinning. Also, polyacrylonitrile is often a more expensive feedstock than is mesophase pitch.

This invention involves a method for producing very good yields of reliably uniform melt spinnable mesophase pitch.

SUMMARY OF THE INVENTION

Broadly, this invention is a process for producing a mesophase pitch from a catalytic pitch. The process comprises: (1) forming a thin film of said catalytic pitch and maintaining said film at a temperature in the range of about 327° C. to about 427° C. and a pressure on a free surface thereof within the range of about 20 microns of mercury to about 1 atmosphere for a time sufficient to produce a heavy isotropic pitch having: a softening point in the range of about 127° C. to about 288° C.; a coking value in the range of about 55 wt % to about 95 wt %; and a maximum mesophase content of about 5 vol %; and (2) agitating said heavy isotropic pitch at a temperature in the range of about 327° C. to about 454° C. for a time sufficient to provide the desired mesophase pitch. Typically, the heavy isotropic pitch is produced with a wiped-film evaporator, which is similar to that described in U.S. Pat. Nos. 4,671,864 and 4,497,789.

The process can be enhanced by passing an inert gas through said heavy isotropic pitch while heating said heavy isotropic pitch at a temperature in the range of about 327° C. to about 454° C. for a time sufficient to provide the desired mesophase pitch. Examples of suitable inert gases are: steam, nitrogen, argon, xenon, helium, and mixtures thereof.

More narrowly, an embodiment of this invention is a process for producing carbon fibers that comprises: forming a thin film of catalytic pitch as described hereinabove to produce a heavy isotropic pitch; passing with agitation an inert gas through said heavy isotropic pitch as described hereinabove to produce the mesophase pitch; converting said mesophase pitch into pitch fibers; and stabilizing said pitch fibers by contacting them with an oxidizing environment at an elevated temperature to form a stabilized product. Optionally, graphite fibers can be produced by carbonizing the stabilized product fibers in an inert atmosphere at specific elevated temperatures.

DESCRIPTION AND PREFERRED EMBODIMENT

Pitches

Figure 1:
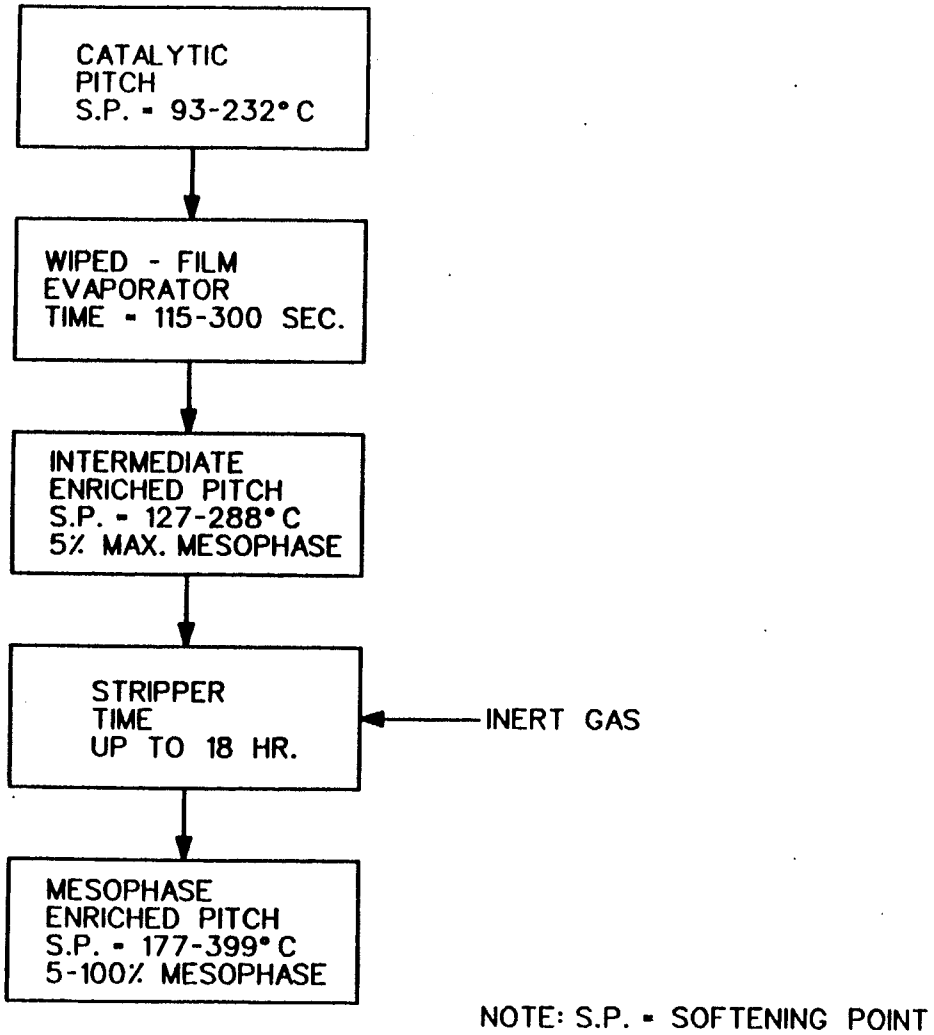
FIG. 1 is a schematic representation of process steps for producing a mesophase pitch from a catalytic pitch.

A high softening point, mesophase pitch material having a normal-heptane insolubles content (ASTM D-3279-78) of about 85 wt % to about 100 wt % and the properties set forth hereinbelow in Table I is either produced or utilized.

TABLE I

Mesophase Enriched Pitch Properties

| Property | Broad | Preferred | More Preferred |
|---|---|---|---|
| Softening Point, °C. | 177–399 | 288–357 | 316–327 |
| Coking Value, wt % | 60–95 | 71–93 | 89–91 |
| Tg[1], °C. | 124–316 | 232–268 | 238–249 |
| Mesophase Content, vol % | 5–100 | 60–95 | 75–85 |
| Toluene Insolubles, wt % | 20–100 | 60–100 | 80–90 |
| Quinoline Insolubles, wt % | 0–95 | 40–80 | 55–70 |
| Helium Density[2], gm/cc | 1.25–1.35 | 1.30–1.33 | 1.30–1.33 |
| Sulfur, wt % | 0.1–3 | 0.1–2 | 0.1–2 |

[1]Glass Transition Temperature
[2]Determined by Beckman Pycnometer, gm/cc @ 25° C.

The softening point, i.e., Mettler softening point, is measured by methods well known to those skilled in the art, preferably, ASTM No. D-3104, modified to use stainless steel balls and cups and a Mettler Softening Point Apparatus with a high-temperature furnace, in view of the high softening points of the pitches involved. The sample chamber is purged with nitrogen in order to prevent oxidation.

The coking value, in terms of wt %, is determined by ASTM No. D-2416 and largely represents the residual carbon after all processing has been completed.

The mesophase content was obtained by using a polarized-light microscope with a rotating stage and a means for quantitatively distinguishing the relative abundance of mesophase areas, which are optically active from that of the optically inactive, non-mesophase areas.

The heavy isotropic pitch formed during the process of this invention typically will have the properties set forth in Table II.

TABLE II

Heavy Isotropic Pitch Properties

| Property | Broad | Preferred | More Preferred |
|---|---|---|---|
| Softening Point, °C. | 127–288 | 232–277 | 256–268 |
| Coking Value, wt % | 55–90 | 71–85 | 78–85 |
| Tg, °C. | 77–243 | 171–238 | 200–216 |
| Mesophase Content, vol % | 5 max | 2 max | 1 max |
| Toluene Insolubles, wt % | 6–50 | 25–45 | 30–40 |
| Quinoline Insolubles, wt % | 0–5 | 0–1 | 0–0.5 |
| Helium Density[1], gm/cc | 1.25–1.32 | | |
| Sulfur, wt % | 0.1–4 | | |

[1]Determined by Beckman Pycnometer, gm/cc @ 25° C.

The aromatic heavy isotropic pitch material, also referred to as "fiber precursor pitch", can be prepared from either an unoxidized, highly-aromatic, high-boiling fraction obtained from the distillation of crude oils, or preferably, from pyrolyzed heavy aromatic slurry oil from the catalytic cracking of petroleum distillates. Such original pitch material is often referred to as "catalytic pitch". The heavy isotropic pitch material can be further characterized as an aromatic heavy isotropic thermal petroleum pitch.

The catalytic pitches that can be utilized in the process of the present invention are characterized by a combination of parameters presented in Table III.

TABLE III

Characterization Parameters for Catalytic Pitch

| Property | Operable Range | Preferred Range |
|---|---|---|
| Softening Point, °C. | about 93–232 | 110–149 |
| Toluene Insolubles, wt % | 0–10 | 0–8 |
| Quinoline Insolubles, wt % | 0–1 | nil |
| Coking Values, wt % | < about 55 | < about 48 |
| Carbon/hydrogen Atomic Ratio | > about 1.2 | > about 1.3 |
| Mesophase Content, % | < about 5 | 0–2 |
| Tg, °C. | > about 35 | > about 85 |
| Ash, wt % | 0–0.2 | 0–0.1 |

Typically, the catalytic pitches utilized in the processes of the present invention are prepared from heavy slurry oil produced in the catalytic cracking of petroleum fractions. Such pitches remain rigid at temperatures closely approaching their melting points. The preferred starting material for preparing the catlytic pitch is a clarified slurry oil or cycle oil from which substantially all paraffins have been removed in a fluid catalytic cracking operation. Extraction with solvents, such as furfural and N-methyl pyrrolidone, remove paraffins. The feed material should be a highly aromatic oil boiling at a temperature in the range of about 315° C. to about 540° C. Such oil is thermally cracked at elevated temperatures and pressures for a time sufficient to produce a catalytic pitch with a softening point in the range of about 93° C. to about 232° C. Of course, catalytic pitches can be prepared by other processing methods known to those skilled in the art.

37 A-240", sold by Ashland Oil, Inc., is a commercially available unoxidized pitch meeting the requirements in Table III. Smith, et al., in "Characterization and Reproducibility of Petroleum Pitches" (U.S. Dept. Com., N.T.I.S. 1974, Y-1921), incorporated herein by reference, describe this pitch in more detail.

Typical results obtained from an analysis of A-240 pitch are presented hereinbelow in Table IV.

TABLE IV

Typical Results Obtained From Analysis of A-240 Pitch

| Test | Method | Results |
|---|---|---|
| Softening Point, °C. | ASTM D-2319 | 120 |
| Density at 25° C., gm/cc | Beckman Pyncometer | 1.230 |
| Coking value | ASTM D-2416 | 52 |
| Flash, COC, °C. | ASTM D-92 | 312 |
| Ash, wt % | ASTM D-2415 | 0.16 |
| BI[1], wt % | ASTM D-2317 | 5 |
| QI[2], wt % | ASTM D-2318 | nil |
| Sulfur, wt % | ASTM D-1552 | 2.5 |
| Distillation, wt % | | |
| 0–270° C. | | 0 |
| 270–300° C. | | 0 |
| 300–360° C. | | 2.45 |
| Specific Heat at, Calories per gm | Calculated | |
| −5° C. | | 0.271 |
| 38° C. | | 0.299 |
| 93° C. | | 0.331 |
| 140° C. | | 0.365 |
| Viscosity, CPS | Brookfield | |
| RPM | Thermosel, Model | |
| 325° F. 1.5 | LVT, Spindle #18 | 2734 |
| 350° F. 1.5 | | 866 |
| 375° F. 1.5 | | 362 |
| 400° F. 3.0 | | 162 |

[1]Benzene Insolubles
[2]Quinoline Insolubles

Increasing Softening Point

The process of the present invention converts a catalytic pitch, such as A-240, to a heavy isotropic pitch having a softening point in the range of about 127° C. to about 288° C. Advantageously, the process is used to obtain mesophase pitches having softening points in the range of about 177° C. to about 399° C. Preferably mesophase pitches having softening points of at least 288° C., and as high as 357° C., can be used as carbon fiber precursors.

For the present invention, the catalytic pitch is converted to the higher softening point aromatic heavy isotropic pitch by the removal or elimination of lower molecular weight species. The use of a very short residence time wiped-film evaporator, such as the type shown by Monty in U.S. Pat. No. 3,348,600 and in U.S. Pat. No. 3,349,828, is the preferred way of converting pitch to a higher softening point material.

By non-mesophase pitch is meant a pitch containing less than about 5% by volume of mesophase material.

Mesophase Pitches

A mesophase pitch is an optically anisotropic material which forms when a catalytic pitch or fiber precursor pitch is maintained at an elevated temperature for a sufficient period of time. An anisotropic material exhibits different optical transmission properties in difference directions.

Therefore, a non-mesophase pitch would generally be referred to in the art as an isotropic pitch, i.e., a pitch exhibiting light transmitting properties which are the same in all directions. Such a non-mesophase pitch can be prepared by the use of a wiped-film evaporator, which enables the time of thermal exposure of the product to be reduced. An example of a suitable wiped-film evaporator is a wiped-film evaporator manufactured by Artisan Industries, Inc., of Waltham, Mass., U.S.A., and sold under the trademark Rototherm. It is a straight-sided, mechanically-aided, thin-film processor operating on the turbulent film principle.

Another example of a suitable wiped-film evaporator is one manufactured by the Pfaudler Co., Division of Sybron Corporation, of Rochester, N.Y., U.S.A.

The catalytic pitch feed material introduced into the wiped-film evaporator unit is induced by inertia and the tips of a rotor blade to form a film on heated walls. Regardless of the evaporation rate, the film covers the entire wall. In this operation, the material is exposed to a high temperature for only a few seconds. Rototherm Wiped-film evaporators are discussed by Monty in U.S. Pat. Nos. 3,348,600 and 3,349,828.

According to the present invention, a process for producing a mesophase pitch from a catalytic pitch, comprises: forming a thin film of said catalytic pitch and maintaining said film at a temperature in the range of about 325° C. to about 425° C. and a pressure in the range of about 20 microns of mercury to about one atmosphere ("atm") for a time sufficient to produce a heavy isotropic pitch having a softening point in the range of about 127° C. to about 288° C., a coking value in the range of about 55 wt % to about 95 wt %, and a maximum mesophase content of about 5 vol %, said film having a thickness in the range of about 0.025 mm (0.001 in) to about 2.5 mm (0.1 in), and subsequently agitating said heavy isotropic pitch at a temperature in the range of about 327° C. to about 454° C. for a time that is sufficient to provide said mesophase pitch.

The percent by volume ("vol. %") of mesophase components in the mesophase pitch is preferably at last 15%, and generally a vol. % in the range of 15 to 100%, and preferably 25 to 95%. The time to produce at least 15% by volume of mesophase is typically in the range of about 0.5 hr to about 18 hr, preferably in the range of about 2 hr to about 10 hr, and more preferably in the range of about 4 hr to about 5 hr. Such mesophase pitch has a toluene insolubles content in the range of about 60 wt % to about 100 wt % and a quinoline insolubles content in the range of about 40 wt % to about 80 wt %. Preferably, agitation is sufficient to mix thoroughly the immiscible mesophase and non-mesophase portions of the pitch. Apparatus suitable for such thorough mixing is a stirrer, propeller, or similar conventional device.

In one process embodiment for producing a mesophase pitch from a catalytic pitch, the heavy isotropic pitch is agitated while passing an inert gas through it at a rate of up to 30 standard cubic feet of inert gas per hour per pound of said heavy isotropic pitch (SCFH/lb). Measurement of SCFH/lb for the inert gas requires the inert gas to be standardized to a temperature of 15.6° C. under a pressure of 1 atmosphere after passage through the pitch. "Inert gas" for purposes of this specification and Claims means a gas which causes substantially no chemical change in the catalytic pitch or intermediate pitch at the temperatures and pressures employed.

A preferred embodiment of a process for producing a mesophase pitch from a catalytic pitch in this invention comprises (1) forming a film having a thickness in the range of about 0.025 mm (0.001 in) to about 1 mm (0.04 in) of said catalytic pitch and maintaining said film, at a temperature in the range of about 363° C. to about 416° C. and a pressure in the rangeof about 150 microns of mercury to about 250 microns of mercury for a time sufficient to produce a heavy isotropic pitch having a softening point in the range of about 232° C. to about 277° C., a coking value in the range of about 71 wt % to about 85 wt %, and a mesophase content that is in the range of about 0 vol % to about 2 vol %, and (2) stirring said heavy isotropic pitch while passing an inert gas through it at a rate of up to about 17 SCFH/lb at a temperature in the range of about 393° C. to about 427° C. for a time sufficient to provide said mesophase pitch. Accordingly, a thin film of the catalytic pitch is treated at specific conditions to form a heavy isotropic pitch having less than about 5 vol % mesophase material and then said heavy isotropic pitch is preferably stirred mechanically and contacted with an inert stripping gas to obtain the desired mesophase pitch. Such contacting is for a time in the range of about 0.5 hr to about 18 hr; preferably, in the range of about 2 hr to about 10 hr; and, more preferably, in the range of about 4 hr to about 5 hr.

The thin film of catalytic pitch is maintained: at a temperature in the range of about 327° C. to about 427° C.; preferably, in the range of about 363° C. to about 416° C.; and, more preferably, in the range of about 399° C. to about 408° C.; under an absolute pressure in the range of about 20 microns of mercury to about 1 atm; preferably, in the range of about 50 microns of mercury to about 500 microns of mercury; and, more preferably, in the range of about 50 microns of mercury to about 225 microns of mercury; and for a time in the range of about 15 sec to about 300 sec; preferably, about 30 sec to about 250 sec; and, more preferably about 90 sec to about 152 sec. The time is selected to provide a heavy isotropic pitch that has a softening point in the range of about 127° C. to about 288V C., a coking value in the range of about 55 wt. % to about 95 wt. % and a maximum mesophase content of about 5 vol %.

Typically a wiped-film evaporator, such as those described hereinabove can be used to change a catalytic pitch, such as A240, which is introduced into the wiped-film evaporator at a rate: in the range of about 0.5 lb/hr/sq ft to about 25 lb/hr/sq ft; preferably, in the range of about 4 lb/hr/sq to about 13 lb/hr/sq ft; and, more preferably, in the range of about 6 lb/hr/sq ft to about 10 lb/hr/sq ft., to a heavy isotropic pitch. Suitably, the thin film has a thickness: in the range of about 0.025 mm (0.001 in) to about 2.5 mm (0.1 in); preferably, in the range of about 0.025 mm (0.001 in) to about 1 mm (0.04 in): and, more preferably, in the range of about 0.51 mm (0.02 in) to about 0.90 mm (0.035 in).

The heavy isotropic pitch can be cooled to room temperature and then heated in appropriate equipment to a desired temperature for stirring and stripping. Alternatively, hot heavy isotropic pitch can be stirred and stripped without cooling in an appropriate vessel. Any inert gas that does not react with the pitch being treated under the conditions that are being employed can be used. Illustrative of such inert gases are hydrogen, nitrogen, argon, xenon, helium, steam, or mixtures thereof.

Stripping or sparging uses an inert gas at a rate: that does not exceed 30 SCFH/lb; preferably, does not exceed 17 SCFH/lb; and still more preferably, as in the range of about 1.5 SCFH/lb to about 5 SCFH/lb.

Stripping time, not including a 3 to 4 hr heat up, will be in the range of about 0.5 hr to about 18 hr. Preferably, the stripping time is in the range of about 2 hr to about 10 hr; more preferably, in the range of about 4 hr to about 5 hr.

Heat-up time is needed to gradually melt the pitch, and then raise the pitch temperature to the stripping temperature, without excessive skin temperature. The stripping is carried out at a vessel temperature in the range of about 327° C. to about 454° C.; preferably, in the range of about 393° C. to about 427° C.; and, more preferably, in the range of about 404° C. to about 410° C. It is carried out at a vessel pressure in the range of about −15 psig to about 140 psig; preferably, in the range of about 0 psig to about 30 psig; and, more preferably, in the range of about 0 psig to about 5 psig. If a stirrer is employed, the agitation of stirring can be carried out at a rate of up to 800 rpm, or higher.

The accompanying FIG. 1 provides a schematic representation of the process of the present invention for producing a mesophase pitch. The time required in the wiped-film evaporator and that in the stripper are given as typical values for these times and are not intended to limit the invention's scope.

Carbon fiber precursors or green fibers can be obtained by melt spinning. Typically, melt spinning comprises forcing molten mesophase pitch under pressure through an orifice under the conditions presented hereinbelow in Table V.

TABLE V

Melt Spinning of Aligned Carbon Fiber Precursors

| | Broad | Preferred | More Preferred |
|---|---|---|---|
| Feed S.P., °C. | 177–399 | 288–357 | 316–327 |
| Spinning Temp., °C. | 204–427 | 366–382 | 368–379 |
| Melt Chamber | 5–1,000 | 60–100 | 80–100 |

TABLE V-continued

Melt Spinning of Aligned Carbon Fiber Precursors

| | Broad | Preferred | More Preferred |
|---|---|---|---|
| Pressure, psig | | | |
| Orifice Diam., in | 0.003–0.02 | 0.005–0.0135 | 0.0078–0.0098 |
| mm | 0.07–0.5 | 0.13–0.35 | 0.2–0.25 |
| Orifice Length/Diam. | 2–100 | 37–63 | 37–51 |
| Filters, mesh size(1) | –150 | 60–150 | 100–150 |
| Winding Rate, ft/min | 10–300 | 45–220 | 114–182 |
| meters/min | 3–91 | 14–67 | 34.7–55.5 |
| Green Fiber Diam., microns | 5–50 | 5–20 | 5–15 |

(1)60-mesh screen used has 30.5% open area
100-mesh screen used has 30.3% open area
150-mesh screen used has 37.4% open area

Stabilization

Figure 2:
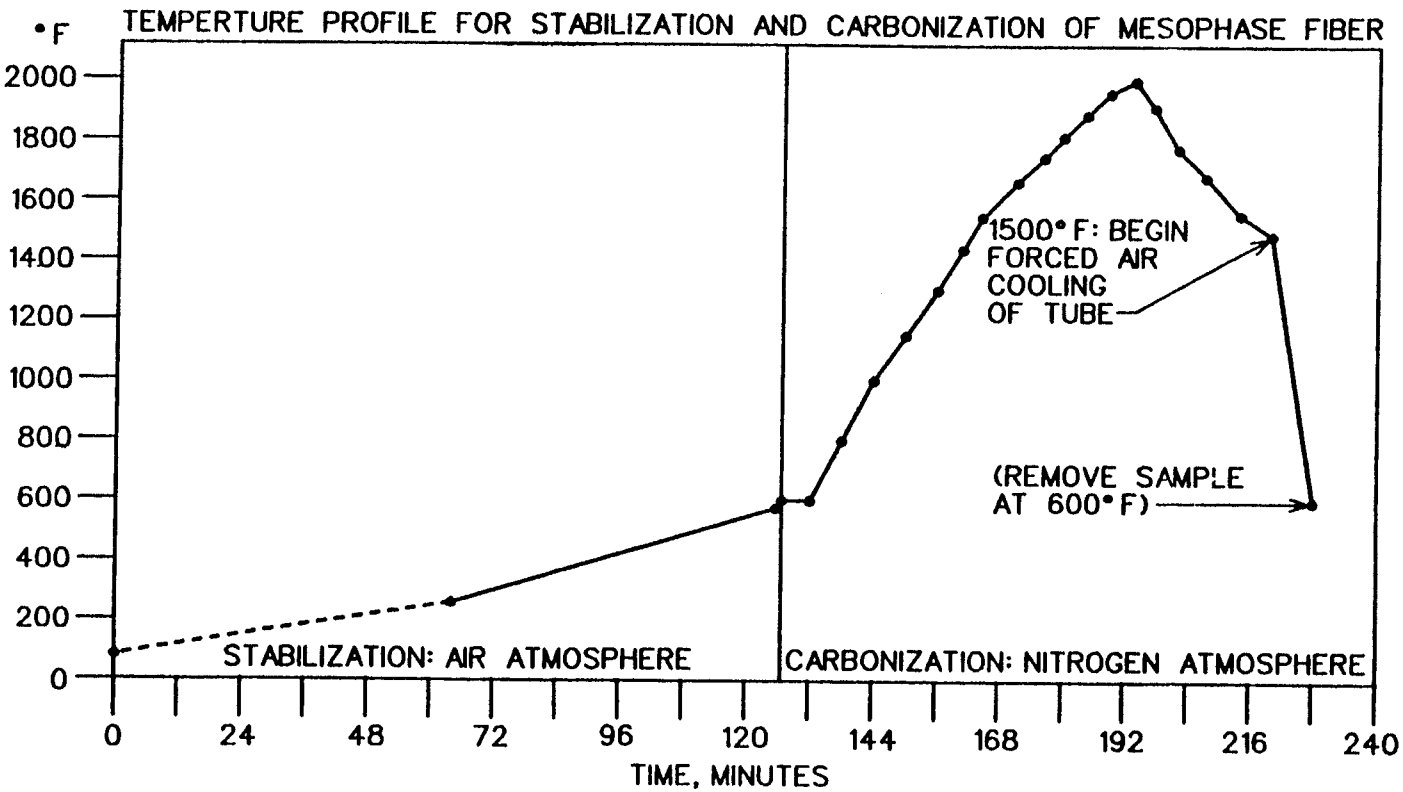
FIG. 2 depicts a stabilization time cycle for treating pitch fibers.

Green fibers are succesfully stabilized by heating in air, or in an "oxidizing environment". An appropriate stabilization/carbonization cycle is represented in FIG. 2. When the temperature of the fibers is increased at a constant rate of 2.4 C°/min (4.33 F°/min), in an air atmosphere; from a point well below the glass transition temperature of the mesophase pitch, to a final stabilization temperature of 310° C., the fibers are rendered infusible and can be satisfactorily carbonized in an inert atmosphere. Using the aforementioned rate of temperature increase and final stabilization temperature, stabilization times of 44–119 min (preferably, 55–119 min and more preferably, 67–119 min) are used when starting temperature are in the range of about 24°–204° C., (preferably, 24°–177° C., and more preferably, 24°–149° C.).

By "oxidizing" environment for a stabilization process is meant either an oxidizing atmosphere, e.g. one containing molecular oxygen, or an oxidizing material impregnated within or aon the surface of the fiber being stabilized. The oxidizing atmosphere can comprise gases, such as air, oxygen-enriched air, oxygen, ozone, nitrogen oxides, sulfur oxides, and similar materials. Conditions employed in the stabilization process are summarized hereinafter in Table VI.

TABLE VI

Stabilization Conditions

| | Broad | Preferred | More Preferred |
|---|---|---|---|
| Air Flow, SCFH | 2–50 | 5–20 | 10–15 |
| Air Pressure, psig | 0–5 | 0–2 | 0–0.5 |
| Starting Temp, °C. | 24–204 | 24–177 | 24–149 |
| Temp Increase, °C./min | 1–6 | 1–4 | 1–3 |
| Final Temp, °C. | 282–343 | 282–327 | 293–310 |
| Stabilization time, min | 14–28 | 27–272 | 52–258 |

It is to be pointed out that air stabilization is much more effective when the fibers are first heated to a starting temperature of about 41° C. to 221° C. below the glass transition temperature of the mesophase pitch prepared by the process of the present invention and thereafter heated at a rate of between about 1° C./min and 6° C./min to a final temperature in the range of about 282° C. to 343° C., until they are stabilized. Under these conditions, the range for stabilization time will be about 15 to about 300 min. As used herein, the "glass transition temperature" ("Tg") represents the temperature of Young's Modulus change. It is also the temperature at which a glassy material undergoes a change in a coefficient of expansion and it is often associated with a stress release. The procedure for thermal mechanical analysis measures Tg, by grinding a small portion of pitch fiber and compacting it into a 0.25 in diameter by 0.125 in aluminum cup. A conical probe is placed in contact with the surface and a 10-gm load is applied. The penetration of the probe is then measured as a function of temperature as the sample is heated at a rate of 10° C. per min in a nitrogen atmosphere. A starting stabilization temperatures well below the glass transition temperature of the mesophase pitch, such as those specified in Table VI, the fibers maintain their stiffness and continue to do so during stabilization process as summarized above. Under these conditions, the fiber forms a skin, and the glass transition temperature increases during stabilization, at a rate sufficient to prevent undesired slumping or fiber-fiber fusion during stabilization, and to render the fiber suitable for carbonization.

Carbonization

The stabilized product, i.e., a filament, roving, or mat of green pitch fibers is heated in an inert atmosphere at a temperature in the range of about 899° C. to about 3,038° C. Preferably, the stabilized product is heated in an inert atmosphere at a temperature in the range of about 982° C. to about 3,038° C., more preferably, in the range of about 1,093° C. to about 3,038° C. The stabilized product is treated to obtain either carbon fibers or graphite fibers, depending on the conditions employed. To obtain carbon fibers, a temperature in the range of about 899° C. to about 2,200° C., preferably, in the range of about 982° C. to about 1,500° C., and, more preferably, in the range of about 1,093° C. to 1,200° C., is employed. In the event graphite fibers are desired, higher temperatures, such as those in the range of about 2,200° C. to about 3,038° C., preferably, in the range of about 2,500° C. to about 3,038° C., and more preferably, in the range of about 2,500° C. to about 3,038° C., must be employed in this treatment. As used herein, the term "carbonizing" refers to the production of either carbon fibers or graphite fibers, the type of fibers being dictated by the temperature employed. The term "carbonized fibers" refers to either carbon fibers or graphite fibers. The term "graphite fibers" refers to carbonized fibers that are graphitized to some degree, i.e., the fibers have at least some graphitic character.

Carbonization conditions are summarized hereinafter in Table VII.

TABLE VII

| | Carbonization Conditions | | |
|---|---|---|---|
| | Broad | Preferred | More Preferred |
| Gas Flow, SCFH | 2-50 | 5-20 | 10-15 |
| Gas Pressure, psig | 0-5 | 0-2 | 0-0.5 |
| Initial Temp, °C. | 24-343 | 24-327 | 293-310 |
| Temp Increase, °C./min | 3-83 | 6-83 | 11-83 |
| Final Temp, °C. | 899-3,038 | 982-3,038 | 1,093-3,038 |
| Carbonization time, min | 7-1,085 | 8-542 | 9-247 |

Alternate Methods

There are various methods available used to produce high softening point pitch material: (1) super-critical extraction, (2) conventional extraction, and (3) anti-solvent extraction.

Other methods available to produce a high-softening point pitch fiber precursor are: (1) oxidation, either catalytic or noncatalytic, in the presence of an oxidizing gas, such as air, NO2, of SO2; (2) reaction of pitch with sulfur; and (3) stripping with an inert gas, such as nitrogen, the pitch while at a temperature of about 300° C.

Broadly, there is provided a process for the production of a mesophase pitch from a catalytic pitch, such as a petroleum pitch derived from a highly aromatic slurry oil. This process comprises forming a thin film of the catalytic pitch and maintaining that film at selected conditions to produce a heavy isotropic pitch having a maximum mesophase content of 5 vol % and subsequently agitating said heavy isotropic pitch or agitating said heavy isotropic pitch while passing an inert gas through said heavy isotropic pitch to provide the mesophase pitch.

There is provided also a process for the production of carbon fiber precursors which can be readily converted to carbon fibers or graphite fibers, which process comprising forming a thin film of a catalytic pitch and maintaining said film with a thickness within the range of about 0.025 mm (0.001 in) to about 2.5 mm (0.1 in) at a temperature in the range of about 327° C. to about 427° C. under a pressure in the range of about 20 microns of mercury to about one atm for a time that is sufficient to produce a heavy isotropic pitch having a softening point in the range of about 127° C. to about 288° C., a coking value in the range of about 55 wt % to about 95 wt %, and a maximum mesophase content of 5 vol %, and subsequently agitating said heavy isotropic pitch while passing an inert gas through said heavy isotropic pitch at a rate of up to 30 SCFH/lb at a temperature in the range of about 327° C. to about 454° C. for a time that is sufficient to provide a mesophase pitch; converting said mesophase pitch into green fibers; and stabilizing said green fibers by contacting said green fibers with an oxidizing environment to form a stabilized product, said stabilizing comprising first heating the green fibers to a starting temperature of about 41° C. to 221° C. below the glass transition temperature of the mesophase pitch prepared by the process of the present invention, and thereafter increasing the temperature at a rate of between about 1° C./min and 6° C./min, to a final temperature in the range of about 282° C. to 343° C., to provide said stabilized product, said stabilizing requiring a minimum time ranging from about 15 to about 300 min. The minimum time does not include any contemplated additional holding of the fibers for various lengths of time before and/or after the period of temperature increase, e.g. at the starting stabilization temperature and/or at the final stabilization temperature. Typically, the mesophase pitch is converted into green fibers by melt spinning.

In addition, carbonized fibers, i.e., carbon fibers or graphite fibers, are produced in this invention by heating stabilized fibers discussed herein before in an inert atmosphere from a temperature in the range of about 24° C. to about 343° C. at a rate in the range of about 3° C./min to about 83° C./min to a final carbonizing temperature in the range of about 899° C. to about 3,038° C.

Apparatus

Figure 3:
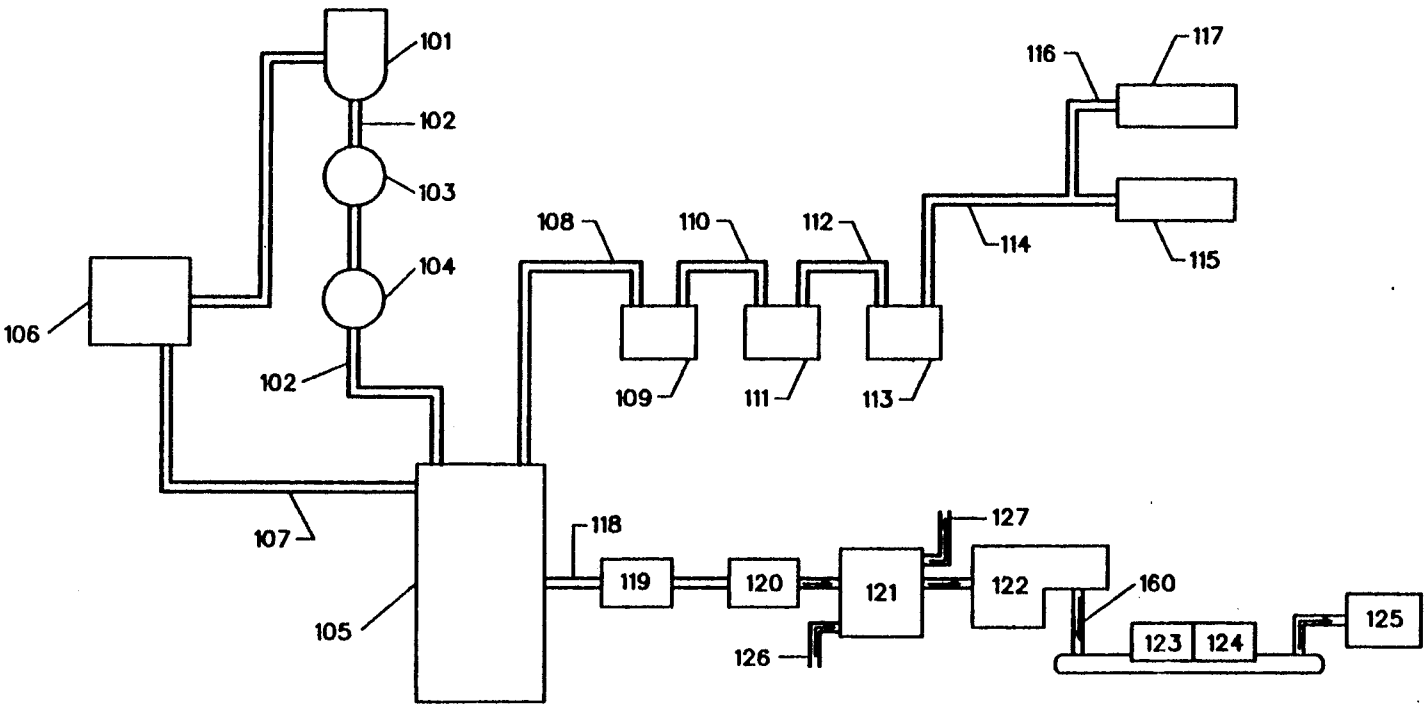
FIG. 3 is a schematic representation of a preferred embodiment of the process of this invention for producing mesophase-containing carbon fibers.

A preferred embodiment of the improved process of the present invention is presented in FIG. 3, which is a schematic diagram of the process. Since FIG. 3 is a simplified flow diagram of a preferred embodiment of this improved process for making carbon fibers and/or their precursors, it does not include all of the various pieces of auxiliary equipment, such as valves, heat exchangers, pumps, conveyors, and the like, which, of course, would be necessary for a complete processing scheme and which would be known and used by those skilled in the art. This example is presented for the purpose of illustration only and is not intended to limit the scope of the present invention.

Referring to FIG. 3, an A-240 pitch material is melted in melt tank 101. Typically the pitch material should be filtered to remove contaminants, the pitch material is pumped through line 102 by Zenith pump 103 and through back pressure valve 104 into vertical wiped-film evaporator 105. The thin film of the catalytic A-240 pitch material is produced in this vertical wiped-film evaporator 105. The wiped-film evaporator 105 is heated by hot oil contained in reservoir 106. The hot oil is pumped into the wiped-film evaporator 105 from reservoir 106 by way of line 107. As the pitch material is treated in the wiped-film evaporator 105, vapors escape from the wiped-film evaporator 105 through line 108 and some of these vapors condense in first condenser 109. The remaining vapors then pass through conduit 110 into second condensor 111, where additional vapors condense. Any remaining vapors pass through conduit 112 into cold trap 113 and exit therefrom by way of conduit 114. Vacuum pump 115, which is connected to conduit 114, applies a vacuum to the system. An absolute pressure in the range of about 150 microns of mercury to about 250 microns of mercury is employed. Conduit 116 connects an auxiliary vacuum pump 117 to the system, thus ensuring that a vacuum is provided in the system in the case of failure of the main vacuum pump 115.

Intermediate heavy isotropic pitch is withdrawn from wiped-film evaporator 105 via line 118 and is passed through line 118 into Zenith gear pump 119.

The heavy isotropic pitch that flows from Zenith pump 119, i.e., the means for recovering the heavy isotropic pitch, is cooled in zone 120 and is collected as flakes of pitch, which are remelted in stripping zone 121 and then melted heavy isotropic pitch in stripping zone 121 is stripped by passing into conduit 126 and out of conduit 127 in inert gas, such as nitrogen, through the melted heavy isotropic pitch at a rate of up to 17 SCFH/lb at a temperature in the range of about 393° C. to about 427° C. for a time in the range of about 2 hr to about 10 hr, e.g., a time that is sufficient to provide the desired mesophase pitch. The desired mesophase pitch will have a softening point in the range of about 288° C. to about 357° C., a coking value in the range of about 71 wt % to about 93 wt %, and a mesophase content in the range of about 60 vol % about 95 vol %.

The mesophase pitch is sent through a melt spinning apparatus in fiber forming zone 122. In the melt spinning apparatus, the mesophase pitch is extruded through a plurality of die orifices of suitable diameter.

The fibers are placed on conveyor 128 and introduced into stabilizing zone 123. In stabilizing zone 123, the melt is contacted by an oxygen-containing atmosphere. The residence time in the stabilizing zone 123 is in the range of about 27 min to about 272 min and the temperature varies from an inlet temperature in the range of about 24° C. to about 177° C. to an outlet temperature in the range of about 282° C. to about 327° C.

Upon leaving stabilizing zone 123, the roving or mat is transported by conveyor into carbonizing zone 124, where it is contacted by an inert atmosphere, which can be nitrogen. In the carbonizing zone 124, the initial temperature is at least 24° C., the final temperature is in the range of about 982° C. to about 3,038° C., and the residence time is in the range of about 8 min to about 542 min. The preferred initial temperature is a temperature in the range of about 24° C. to about 327° C. The carbonized or graphitized fiber, roving, or mat is then recovered in fiber recovery zone 125.

The orifices in fiber forming zone 122 are not shown, but an array of lines 160 are shown to depict the plurality of fibers melt spun onto conveyor 128. Conveyor 128 transports the melt spun fibers through at least two zones; zone 123 for stabilizing and zone 124 for carbonizing. Although conveyor 128 is shown schematically as a continuous single belt through both zones 123 and 124, in practice more than one conveyor and more than one stabilizing and/or carbonizing zone may be used.

Optionally as in the FIG. 3, a cooling zone 120 is used to produce flake like material. This flake like material is indicated to be transferred or transferable through some means to melt stripping zone 121. In melt stripping zone 121, the flake material is remelted and stripped by passing inert gas such as nitrogen into conduit 126 through stripping zone 121, and then removed through conduit 127. After being melted and stripped the pitch now in the mesophase form is then transferred to a fiber forming zone 122. The primary formation of mesophase occurs during melt stripping in zone 121.

The following examples are presented for the purpose of illustration only and are not intended to limit unnecessarily the scope of the present invention.

EXAMPLE 1

A preferred embodiment of this present invention is used to obtain a mesophase pitch and carbon fiber precursors.

In this example, the catalytic pitch A-240, obtained from Ashland Petroleum Company, is first converted into a heavy isotropic pitch by employing that portion of the process scheme presented in FIG. 3 through and including pitch cooling zone 120. The preparation of this heavy isotropic pitch is carried out in a wiped-film evaporator the resulting heavy isotropic pitch is found to have the properties presented hereinbelow in Table VIII.

TABLE VIII

| Properties of Heavy Isotropic Enriched Pitch Obtained in an Embodiment of the Present Invention | |
|---|---|
| Softening Point (S.P.), °C. | 266–268 |
| Coking Value, wt % | 81.4 |
| Mesophase, vol % | 0–2 |

The cooled heavy isotropic pitch, is employed as the feed to a flanged stripping vessel. Several runs are carried out in this vessel with this heavy isotropic pitch.

The flanged stripping vessel had an internal diameter of 6.25 in and a height of 9.5 in. Its total volume is 1.25 gal. A flanged cover, sealed with graphite tape, is bolted to this stripping vessel. An agitator, consisting of a propeller with six blades, 3 in in diameter, is centered in the stripping vessel and located 3 in from its bottom. The agitator is driven by a ¼-hp motor at 200 to 800 rpm. The agitator is mounted on a 5/16-in shaft, which is sealed by means of a stuffing box containing commercially-available graphite-covered asbestos string. Located in the stripping vessel and near its walls are four baffles, 2.5 to 3 in from the center of the vessel to prevent "vortexing" of molten pitch as it is being agitated. There is also located at a level below the propeller and 2.5 in from the center of the stripping vessel at ¼-in outside diameter sparge tube. In addition, a heated, ⅜-in outside diameter outlet line is employed to carry away stripping gas and entrained overhead material. This heated outlet line is attached to an overhead receiver assembly by means of a section of unheated ⅜-in tubing, which is kept short, about 3 in in length, to avoid clogging. The overhead assembly consists of a trap for liquids and semi-solids, followed by a scrubber for material which becomes entrained in the stripping gas as an aerosol. The liquid trap consists of a 4-liter Erlenmeyer flask with a 2-hole rubber stopper and contains about 250 ml of acetone and 250 ml of toluene. Another short, unheated section of ⅜-in tubing, identical to the one connecting the heated outlet from the stripping vessel to the liquid trap, serves to connect the liquid trap to an unheated line leading to the second (aerosol) trap. Both short tubing sections are held in place at the top of the flask by means of a rubber stopper. These unheated tubing sections serve as inlet and outlet for the first liquid trap, which serves to entrap liquid or semi-solid overhead material without becoming clogged. The solvents are placed in the liquid trap in order that such solvents become entrained in the stripping gas along with remaining untrapped overhead, so as to make the aerosol less viscous and easier to handle as it condenses in the second trap and connecting tubing. The second trap, employed as a means for scrubbing the aerosol to remove remaining overhead fumes, consists of a cylinder, 20 inches height and 30 inches in diameter, open at the top and packed with steel wool except for a 3-in zone at the bottom. Toluene is poured into the cylinder until the liquid level was at the middle of the cylinder. The aerosol-containing line from the first trap is routed through the open top end of the cylinder of the second trap and down through the steel wool packing in order to enable the stripping gas to bubble through the toluene in the unpacked bottom zone. The steel wool is employed to break up the bubbles of aerosol-containing stripping gas and, consequently, to increase their surface area and allow for more efficient scrubbing by the solvent. A thermocouple port is located 2.5 in from the stripping vessel and extends to a point 2 in from the bottom of the vessel. The thermocouple is employed to measure the internal temperature.

Essentially oxygen-free nitrogen is employed as the stripping medium. A regulated supply of the nitrogen is connected to the sparge tube. The nitrogen has been preheated to within 07° C. of the internal operating temperature of the stripping vessel. The flow of stripping gas is measured at standard conditions, i.e., 16° C. and 1 atm pressure. The stripping gas is preheated by passing it through a vessel containing stainless steel wool, which provides a high surface area and heat capacity for transfer of heat to the nitrogen stripping gas.

In each run, the pitch is heated gradually to a temperature of 404° C. with temperature control at the skin of the reactor vessel to prevent skin overheating as the pitch was melted. The skin is maintained at a temperature sufficient to heat the pitch to operating temperature in a reasonable period of time, but not so high a temperature as to cause overheating. Agitation is initiated as soon as the pitch became molten. When the temperature reaches a value of about 393° C., the temperature control is switched to the internal thermocouple, and heating is continued until the feed pitch reaches a temperature of 404° C. During this heat-up procedure, a very small flow of nitrogen is maintained through the sparge tube in order to keep it clear and to prevent oxidation of the hot pitch. As soon as the internal temperature reaches a value of 404° C., the flow of nitrogen stripping gas through the sparge tube is initiated and is maintained at a rate of 4.5 SCFH/1b for a period of time of 4.5 hr. When the stripping has been completed, both the flow of stripping gas and the heating are discontinued and the stripping vessel is allowed to cool at its natural rate to room temperature. The product, mesophase, pitch, is removed from the stripping vessel, weighed, ground, mixed well, and analyzed for its softening point and glass transition temperature. Prior to grinding, several small samples are taken from various areas of the stripping vessel for mesophase analysis, in order to preserve the original texture of each sample. The mesophase content is determined using a polarized-light microscope with a rotating stage and a means for quantitatively distinguishing the relative abundance of mesophase areas which are optically active, or appear bright in certain orientations, from that of the optically inactive, non-mesophase areas, which always appear dark regardless of their orientation with respect to the polarizers. The properties of the products obtained from the various runs conducted in this example are summarized hereinbelow in Table IX.

TABLE IX

Properties of Mesophase Pitch Obtained in Embodiment of the Present Invention

| Feed = heavy isotropic pitch | | | | 3,000 gm of feed used | |
|---|---|---|---|---|---|
| Run No. | Stripping Time, hr | S.P. °C. | Tg °C. | Prod/Feed wt % | Mesophase vol % |
| 1 | 4.5 | 325 | 241 | 89 | 85 |
| 2 | 4.5 | 334 | 246 | 89 | 80 |
| 3 | 4.5 | 329 | 241 | 90 | 88 |
| 4 | 4.5 | 328 | 238 | 89 | 90 |
| 5 | 4.5 | 325 | 239 | 90 | 88 |
| 6 | 4.5 | 337 | 236 | 88 | 84 |
| 7 | 4.5 | 329 | 242 | 89 | 85 |
| 8 | 4.5 | 326 | 252 | 89 | 85 |
| 9 | 4.5 | 328 | 247 | 89 | 87 |
| 10 | 4.5 | 327 | 255 | 89 | 80 |
| 11 | 4.5 | 323 | 260 | 89 | 78 |
| 12 | 4.5 | 328 | 250 | 89 | 85 |
| Average | | 328 | 245 | 89 | 84 |
| Standard Deviation | | | | 0.5 | 4 |

As evidenced by the data in Table IX, the embodiment of the process of the present invention provides a mesophase pitch having a mesophase content of at least 75 vol% and showed no value as low as 75 vol%.

EXAMPLE 2

In this example, the technique disclosed by Chwastiak in U.S. Pat. No. 4,209,500 is employed to provide a mesophase pitch. The catalytic pitch A-240, obtained from Ashland Petroleum Company, is employed as the feed pitch to the stripping vessel described hereinabove in Example 1. The conditions, including feed weight, stripping temperature, stripping gas flow rate, and stripping time, as identical to those employed in Example 1.

Several runs are made and the properties of the various products obtained and are summarized hereinbelow in Table X.

TABLE X

| Properties of Mesophase Pitch Obtained by Prior Art Technique | | | | | |
|---|---|---|---|---|---|
| Feed = A-240 pitch | | | | 3,000 gm of feed used | |
| Run No. | Stripping Time, hr | S.P. °C. | Tg °C. | Prod/Feed wt % | Mesophase vol % |
| 13 | 4.5 | 292 | 239 | 60 | 49 |
| 14 | 4.5 | 291 | 235 | 54 | 20 |
| 15 | 4.5 | 290 | 236 | 54 | 42 |
| 16 | 4.5 | 287 | 243 | 54 | 59 |
| 17 | 4.5 | 278 | 234 | 54 | 55 |
| 18 | 4.5 | 281 | 223 | 55 | 71 |
| 19 | 4.5 | 288 | 236 | 55 | 47 |
| 20 | 4.5 | 283 | 237 | 54 | 45 |
| 21 | 4.5 | 286 | 244 | 55 | 23 |
| 22 | 4.5 | 287 | 190 | 52 | 23 |
| 23 | 4.5 | 283 | 216 | 54 | 36 |
| Average | | 286 | 230 | 55 | 43 |
| Standard Deviation | | | | 2 | 16 |

The data presented in Table X demonstrate that the prior art technique of stripping the catalytic pitch under selected conditions and in this case under conditions similar to those employed in the process of the present invention, including the same amount of stripping time, do not provide a mesophase pitch having as good a mesophase composition as does the process of the present invention. The softening point of the mesophase pitch is much lower and the average mesophase content of the mesophase pitch is only about 50% of the values obtained in the process of the present invention.

Measurement of the mesophase content in the mesophase pitches obtained by the prior art technique is difficult due to the non-uniformity of the mesophase distribution in the sample. This is reflected in the large variation in the results for vol% mesophase, i.e., standard deviation=16 vol%. On the other hand, the standard deviation is only 4 vol% for the mesophase pitches obtained from the embodiment of the present invention as described hereinbefore in Example 1 and presented in Table IX. Furthermore, it is noted that the products obtained via the prior art technique consisted of isotropic material as the continuous phase with coalesced mesophase domains suspended nonuniformly therein while products of the present invention of Example 1 consisted of mesophase material as the continuous phase with small isotropic areas imbedded uniformly throughout. From such observations, it became evident that more stripping would be required to obtain an acceptable fiber precursor by the prior art technique.

Several of the mesophase pitch products obtained by the prior art technique and described in Table X were blended together and such blend was treated to an additional stripping step in the above-described stripping apparatus. Feed A was a blend of the products obtained from Runs 13 through 19. Feed B is a blend of the products obtained from Runs 20 through 23. Conditions that are employed are those used for the runs in Example 1, except for adjustments in stripping time to adjust the final product softening point to a value as close as possible to the average value of the softening points of the products obtained in Example 1.

The results of the properties of the products obtained from this second stripping step are summarized hereinbelow in Table XI.

TABLE XI

| Properties of Mesophase Pitch Obtained by Prior Art Technique in Two Steps | | | | | | |
|---|---|---|---|---|---|---|
| Run No. | Feed | Stripping Time, hr | S.P. °C. | Tg °C. | Prod/Feed wt % | Mesophase vol % |
| 24 | A | 4.5 | 329 | 244 | 93 | 75 |
| 25 | A | 4.0 | 326 | 237 | 94 | 70 |
| 26 | A | 4.0 | 326 | 248 | 93 | 72 |
| 27 | B | 5.0 | 325 | 235 | 93 | 79 |
| Average | | 4.4 | 327 | 241 | 93 | 74 |
| Standard Deviation | | | | | 0.5 | 4 |

A composition of the data in Table IX with those in Table XI suggests that the process of the present invention provides a suitable mesophase pitch in a time that is substantially shorter than the time required to provide a similar mesophase pitch by means of the stripping technique employed by Chwastiak. The glass transition temperatures of the products prepared by the prior art technique are quite similar to those of the mesophase products obtained by the process of the present invention. The softening point of the mesophase pitch obtained from applying the present invention as described in Example 1, 328° C. average, is essentially the same as that of the mesophase pitch obtained with the prior art stripping technique as described in this example, 327° C. on the average. The second step of the prior art stripping technique results in an acceptable vol% mesophase content, and provides a product with mesophase material as the continuous phase, with the remaining non-mesophase material embedded fairly uniformly throughout the mesophase material. However, the mesophase pitch obtained from applying the present invention has an average mesophase content of 84 vol%, while the mesophase pitch obtained from the prior art stripping has an average mesophase content of only 74 vol%.

EXAMPLE 3

The mesophase pitch obtained by the process of the present invention and described in Table VI herinabove is then remelted and subjected to melt spinning by forcing the pitch by a nitrogen pressure of 80 psig through an orifice having a length of 0.5 in and a diameter of 0.0098–0.0135 in (1/d=37-51). A spinning temperature of 370° C. is employed. The molten pitch so extruded was drawn down and wound by means of a reel 6.5 in in diameter and rotating at 335 rpm. The fibers obtained are found to have a mean diameter of 15 microns. The spinning of the mesophase pitch is undertaken for several of the pitches obtained in Example 1.

Thermogravimetric analysis is employed in these tests to deterimine the minimum temperature at which detectable volatilization of mesophase pitch samples occurs at atmospheric pressure. This technique is conducted as follows:

A 20–40 mg sample of mesophase pitch is placed into a DuPont 9900 Thermal Analysis System (with Model 951 Thermogravimetric Analysis attachment), which consisted of the following:

1. an electronic balance of sufficient precision to continuously detect and record minute weight changes in the sample as a function of temperature;
2. an accurate and precise means for controlling and recording sample temperature during the analysis;
3. a means for continuously increasing the sample temperature at a precisely controlled, linear rate;

4. a chamber or enclosure containing the balance and the sample chamber, which can be purged with an inert gas to prevent sample oxidation; and
5. a means for automatic and electronic recording of the raw data for sample weight and temperature vs time for later calculation and plotting as percentage weight loss vs temperature.

After placement of the sample into the sample chamber and purging with nitrogen for a time sufficient to remove all oxygen from the balance chamber, the sample was heated at a constant rate of 10° C./min. Sample weight was automatically and continuously recorded from 300° C., a temperature below which no detectable volatilization was observed in any of the mesophase pitch samples, to 650° C., a temperature above which no further weight loss was observed in any of the samples.

From results obtained in this manner, the following are calculated:

1. fixed carbon, or weight percentage of the sample remaining unvolatilized at 650° C.;
2. initial volatilization temperature, or temperature corresponding to volatilization of the first 0.1 wt% of the sample at atmospheric pressure; and
3. intercept temperature, or the temperature at which the initial baseline of a plot of wt% remaining vs temperature (corresponding to a rate of weight loss vs temperature of 0 wt% per degree centigrade) intersects a line tangent to the region of said plot of wt% remaining vs temperature representing the maximum observed rate of weight loss in the sample.

These measurements, particularly the initial volatilization temperature, provided a quantitative measure of the tendency of mesophase pitches to volatilize during melt spinning, with resultant deleterious effect on spinning performance. By this method, the spinnability of mesophase pitch products was quantitatively measured and related to qualitative observations of spinning performance.

The data representing these spinning runs are provided hereinbelow in Table XII.

TABLE XII

Spinnablility of Mesophoase Pitch Obtained in Embodiment of Present Invention

| | | Thermogravimetric Analysis | | | Spinning | | |
|---|---|---|---|---|---|---|---|
| Run No. | Mesophase Run No. | 0.1% vol °C. | Intercept °C. | Fixed C wt % | Temp °C. | Results & Green Diam, u | |
| 28 | 5 | 398 | 482 | 79.5 | 370 | Fair | 15 |
| 29 | 7 | 382 | 484 | 79.2 | 385 | Fair | 14 |
| 30 | 7 | 382 | 484 | 79.2 | 388 | Fair | 13 |
| 31 | 8 | 392 | 484 | 79.7 | 382 | Good | 15 |
| 32 | 9 | 366 | 487 | 79.2 | 382 | Avg | 14 |
| 33 | 11 | 378 | 482 | 79.1 | 377 | V. Good | 14 |
| 34 | 12 | 375 | 480 | 79.8 | 382 | Fair | 11 |
| Average | | 382 | 483 | 79.4 | 381 | | 14 |
| Standard Deviation | | 10.6 | 2.2 | 0.3 | 5.8 | | 1 |

The results presented in Table XII indicate that the mesophase pitch obtained by applying the present invention is spinnable.

EXAMPLE 4

An attempt is made to spin a mesophase pitch obtained by the prior art technique using one step. The product from Run 14 was used. In addition, this and two similar products from Runs 18 and 19 are analyzed from volatilization temperature using the method described hereinabove in Example 3. The results of these tests are presented hereinbelow in Table XIII.

TABLE XIII

Spinnablility of Mesophase Pitch Obtained from Prior Art Stripping (1 STEP)

| | | Thermogravimetric Analysis | | | Spinning | |
|---|---|---|---|---|---|---|
| Run No. | Mesophase Run No. | 0.1% vol °C. | Intercept °C. | Fixed X wt % | Temp °C. | Results & Green Diam, u |
| 35 | 14 | 342 | 444 | 69.8 | 316 | Won't Spin |
| 36 | 18 | 440 | 68.4 | — | — | |
| 37 | 19 | 358 | 434 | 69.4 | — | — |
| Average | | 345 | 439 | 69.2 | | |
| Standard Deviation | | 12.2 | 5.0 | 0.7 | | |

The attempt at melt spinning of the mesophase pitch obtained from the first step of prior art stripping are unsuccessful because of excessive breakage and unevenness of flow, making the fiber impossible to wind on the reel.

Although not intending that the present invention be bound by theory, it is hypothesized that this material is impossible to spin because of its non-uniform nature and also because mesophase material does not constitute the continuous phase. Although material from the first step of prior art stripping retains a low softening point and can be melted at temperatures below the volitilization temperature, such material is nevertheless not sufficiently uniform in composition to flow smoothly through a die.

EXAMPLE 5

In this example, samples of the products of mesophase pitch are obtained with the prior art technique employing two steps are subjected to melt spinning. The results of this spinning are presented hereinbelow in Table XIV.

TABLE XIV

| Run No. | Mesophase Run No. | Spinnability of Mesophase Pitch Obtained from Prior Art Stripping (STEP 2) Thermographic Analysis 0.1% vol °C. | Intercept °C. | Fixed C wt % | Spinning Temp °C. | Results & Green Diam, u | |
|---|---|---|---|---|---|---|---|
| 38 | 24 | 350 | 463 | 78.6 | 379 | Poor | 14 |
| 39 | 24 | 350 | 463 | 78.6 | 385 | Poor | 14 |
| 40 | 24 | 350 | 463 | 78.6 | 382 | Fair | 16 |
| 41 | 25 | 353 | 457 | 77.0 | 382 | Fair | 17 |
| 42 | 25 | 353 | 457 | 77.0 | 370 | Poor | 15 |
| 43 | 26 | 350 | 477 | 79.4 | — | — | — |
| 44 | 27 | 356 | 469 | 78.8 | 381 | Poor | 13 |
| Average | | 352 | 464 | 78.4 | 380 | | 15 |
| Standard Deviation | | 2.4 | 7.0 | 1.0 | 5.2 | | 1 |

While the mesophase pitch obtained from the one step of prior art stripping did not provide fibers, a mesophase pitch obtained from the prior art stripping in two steps did furnish some fibers. However, this melt spinning is more difficult than the spinning of the mesophase pitch obtained from the applying the present invention. The length of spinning trials is shorter and the fiber breakage is more frequent. In addition, the average temperature required to volatilize the initial 0.1 wt % of the mesophase pitch obtained from the embodiment of the present invention, as determined by thermogravimetric analysis, is substantially greater than the average temperature needed to volatilize the initial 0.1 wt % of the mesophase pitch derived from the prior art stripping technique.

Although it is not intended that the scope of the present invention be bound by the following theory, it is hypothesized that the observed better spinning behavior of mesophase pitch obtained from applying the present invention, as compared with that of the mesophase pitch derived from the prior art stripping technique, is a direct result of the above-mentioned difference in the 0.1 wt % volatility temperature for the respective products. It has thus been demonstrated that the embodiment of the present invention results in a mesophase pitch that is superior to the mesophase pitch produced by the prior art stripping technique.

EXAMPLE 6

In this example, several of the fibers obtained from the mesophase pitch prepared by applying the present invention are stablilized, i.e., made infusabile, by exposing them to air while increasing the temperature from room temperature to 310° C. at a rate of 2.4° C./min. The fibers are then carbonized under a nitrogen atmosphere by raising the temperature to a value in the range of about 1,093° C. to about 1,121° C. A single tube furnace having a programmable temperature control and a selectable supply of air or nitrogen is employed for both stabilization and carbonization. In Runs Nos. 46 and 48, carbonization is carried out to a temperature of 1,093° C. In the other runs, carbonization is conducted to a temperature of 1,121° C. As shown in the table hereinbelow, the 28° C. difference in carbonization temperature produces no significant effect on properties. A typical temperature profile and the method of exposure of the fibers during stabilization and carbonization are illustrated in FIG. 2. The carbonized fibers are then analyzed for tensile strength, Young's modulus, and diameter. The results of these carbonization tests are presented hereinbelow in Table XV.

TABLE XV

| Combination Run No. | Mesophase Run No. | Properties of Carbonized Fibers Obtained From Embodiment of the Process of the Present Invention Strength, KPSI | Modulus, MPSI | Diameter, Microns |
|---|---|---|---|---|
| 45 | 5 | 190 | 16.8 | 12 |
| 46 | 5 | 184 | 17.5 | 14 |
| 47 | 7 | 209 | 19.5 | 10 |
| 48 | 7 | 218 | 17.2 | 10 |
| 49 | 8 | 132 | 13.7 | 13 |
| 50 | 9 | 177 | 15.3 | 10 |
| 51 | 11 | 200 | 16.8 | 10 |
| 52 | 12 | 204 | 18.9 | 10 |
| Average | | 189 | 17.0 | 11 |
| Standard Deviation | | 27 | 1.8 | 2 |

The tensile strength was expressed in terms of thousands of pounds per sq in, while Young's modulus was expressed in terms of millions of pounds per sq in. The gauge length employed for these measurements was 0.7 in. (1.8 cm). The values for these properties of the carbonized fibers are quite satisfactory.

EXAMPLE 7

In this example, several of the product fibers obtained from the mesophase pitch prepared in two steps by the prior art stripping method as described hereinabove in Example 2 and then melt spun as described hereinabove in Example 5 are stabilized by exposing them to air as described hereinabove in Example 6 and then carbonized by raising the temperature to 1,121° C. as described hereinabove in Example 6. The resulting fibers are analyzed for tensile strength, Young's modulus, and diameter. These properties are summarized hereinbelow in Table XVI.

TABLE XVI

| Combination Run No. | Mesophase Run No. | Properties of Carbonized Fibers Obtained From Prior Art Mesophase Enriched Pitch Strength, KPSI | Modulus, MPSI | Diameter, Microns |
|---|---|---|---|---|
| 53 | 24 | 188 | 17.0 | 10 |
| 54 | 24 | 173 | 16.5 | 13 |
| 55 | 24 | 199 | 16.1 | 12 |
| 56 | 25 | 173 | 15.2 | 15 |
| 57 | 25 | 142 | 14.5 | 14 |
| 58 | 27 | 152 | 14.9 | 14 |
| Average | | 171 | 15.7 | 13 |
| Standard Deviation | | 21 | 1.0 | 2 |

A comparison of the data in Table XVI with the data in Table XV reveals that the carbonized fibers obtained from the mesophase pitch prepared by applying the present invention have average values for tensile strength and modulus which are higher than the respective average properties for fibers made from pitch of the same softening point but prepared according to the prior art stripping method. This demonstrates also that mesophase pitch prepared by applying the present invention is suitable for use in the manufacture of carbon fibers.

These data indicate that a mesophase pitch can be obtained by the process of the present invention, even though the heavy isotropic pitch is not stripped with an inert gas.

EXAMPLE 8

In this example, a mesophase pitch is prepared in a manner similar to the preparation of the mesophase pitch described in Example 1 hereinabove, with the exception that a heavy isotropic pitch having a softening point of 264° C. was used as the feed for stripping and the stripping time was 5 hr. The mesophase pitch produced in this example has a softening point of 325° C., a Tg of 243° C., a Product/Feed ratio of 90 wt %, and a mesophase content of 69 vol %.

The results obtained from the above examples demonstrate that mesophase pitches can be produced by the processes of the present invention and that such pitches are less volatile than pitches of the prior art, i.e., the mesophase pitches provided by the present invention can be raised without volatilization to temperatures that are higher than those required for volatilization by the prior art pitches. This property of a higher volatilization temperature of the mesophase pitches produced by the processes of the present invention enables those processes to provide fibers which are more easily spinnable than the fibers produced in the prior art Chwastiak process.

Modifications

It will be understood by those skilled in the art, that the invention is not to be limited by the above examples and discussions, in that the examples are susceptible to a wide number of modifications and variations without departure from the invention.

References to documents made in this specification is intended to expressly incorporate, herein by reference, such documents including any patents or other literature references cited within such documents.

What is claimed is:

1. A process for the production of a stabilized carbon fiber which process comprises: forming a film having a thickness in the range of about 0.025 mm (0.001 in) to about 2.5 mm (0.1 in), of a catalytic pitch; maintaining said film at a temperature in the range of about 327° C. to about 427° C. and a pressure in the range of about 20 microns of mercury to about 1 atm for a time that is sufficient to produce a heavy isotropic pitch having a softening point in the range of about 127° C. to about 288° C., a coking value in the range of about 55 wt % to about 95 wt %, and a maximum mesophase content of 5 vol %; agitating said heavy isotropic pitch while passing an inert gas through said heavy isotropic pitch at a rate of up to about 30 SCFH/1b at a temperature in the range of about 327° C. to about 454° C. for a time that is sufficient to provide a mesophase pitch having a vol. % of mesophase of at least 60; converting said mesophase pitch into green fibers; and stabilizing for a minimum time ranging from about 14 to about 288 minutes said green fibers with an oxidizing agent while heating said green fibers to a starting temperature of about 41° C. to 221° C. that is below the glass transition temperature of the mesophase pitch, and thereafter increasing the temperature of said green fiber at a rate of between about 1° C./min and 6° C./min to a final temperature in the range of about 282° C. to 343° C. to provide a stabilized carbon fiber.

2. The process of claim 1, wherein said forming a film and said maintaining a film are carried out in a wiped-film evaporator.

3. The carbon fiber produced by the process of claim 1.

4. The process of claim 1, wherein said green fibers are produced by melt spinning said mesophase pitch.

5. The process of claim 4, wherein said oxidizing agent comprises an oxidizing atmosphere or an oxidizing material impregnated within or on the surface of the green fibers being treated.

6. The process of claim 5, wherein said oxidizing atmosphere comprises a member selected from the group consisting of air, oxygen-enriched air, oxygen, ozone, nitrogen oxides, sulfur oxides, and mixtures thereof.

7. The process of claim 5, wherein said oxidizing material comprises a member selected from the group consisting of sulfur, nitrogen oxides, sulfur oxides, peroxides, and persulfates.

8. The process of claim 6, wherein said oxidizing atmosphere comprises air and said stabilizing is conducted at an air flow rate in the range of about 2 SCFH to about 50 SCFH and an air pressure in the range of about 0 psig to about 5 psig.

9. The process of claim 8, wherein said stabilizing comprises first heating the green fibers to a starting temperature of about 68° C. to 221° C. that is below the glass transition temperature of the mesophase pitch prepared by the process of the present invention, and thereafter increasing the temperature at a rate of between about 1° C./min and 4° C./min to a final temperature in the range of about 282° C. to about 327° C. to provide said stabilized product, said stabilizing requiring a minimum time ranging from 27 to 272 min, and said air flow rate being maintained in the range of about 5 SCFH to about 20 SCFH at an air pressure in the range of about 0 psig to about 2 psig.

10. The process of claim 8, wherein said stabilizing comprises first heating the green fibers to a starting temperature of about 96° C. to 221° C. that is below the glass transition temperature of the mesophase pitch prepared and thereafter increasing the temperature at a rate of between about 1° C./min and 3° C./min to a final temperature in the range of about 293° C. to 310° C. to provide said stabilized carbon fiber, said stabilizing requiring a minimum time ranging from about 52 to about 258 min, said air flow rate being maintained in the range of about 10 SCFH to about 15 SCFH at an air pressure in the range of about 0 to psig to about 0.5 psig.

11. The stabilized carbon fiber precursors produced by the process of claim 8.

12. A process for the production of a stabilized carbon fiber which can be converted readily to a carbonized carbon fiber or graphite fiber, which process comprises: forming a film having a thickness in the range of about 0.51 mm (0.02 in) to about 0.9 mm, of a catalytic pitch at a temperature in the range of about 399° C. to about 408° C. and a pressure in the range of about 180 microns of mercury to about 210 microns of mercury for a period of time in the range of about 90 sec to about 152 sec in a wiped-film evaporator to produce a heavy isotropic pitch having a softening point in the range of about 256° C. to about 268° C., a coking value in the range of about 78 wt % to about 85 wt %, and a maximum mesophase content of about 5 vol %; agitating said heavy isotropic pitch while passing an inert gas through said heavy isotropic pitch at a rate in the range of about 1.5 SCFH/1b to about 5 SCFH/1b at a temperature in the range of about 404° C. to about 410° C. for a period of time in the range of about 4 hr to about 5 hr to provide a mesophase pitch having a vol. % of mesophase components of at least 60; converting said mesophase pitch into green fibers by means of melt spinning; and stabilizing said green fibers for a minimum time ranging from about 52 to about 258 min. by contacting said green fibers with oxidizing species selected from the group consisting of air, oxygen-enriched air, oxygen, ozone, nitrogen oxides, sulfur oxides, and mixtures thereof, and heating the green fibers to a starting temperature of about 96° C. to about 221° C. that is below the glass transition temperature of the mesophase pitch and thereafter increasing the temperature of said fiber at a rate of between about 1° C./min and 3° C./min to a final temperature in the range of about 293° C. to 310° to produce a stabilized carbon fiber.

13. The stabilized carbon fiber produced by the process of claim 12.

* * * * *

UNITED STATES PATENT AND TRADEMARK OFFICE

CERTIFICATE OF CORRECTION

PATENT NO. : 5,238,672

DATED : August 24, 1993

INVENTOR(S) : Michael B. Sumner; William P. Hettinger, Jr.

It is certified that error appears in the above-identified patent and that said Letters Patent is hereby corrected as shown below:

Column 20, lines 34-46, should read as follows:

TABLE XIII

Spinnability of Mesophase Pitch Obtained from Prior Art Stripping (1 STEP)

| | | Thermogravimetric Analysis | | | Spinning | |
|---|---|---|---|---|---|---|
| Run No. | Mesophase Run No. | 0.1% vol °C | Intercept °C | Fixed C wt % | Temp °C | Results & Green Diam, u |
| 35 | 14 | 342 | 444 | 69.8 | 316 | Won't Spin |
| 36 | 18 | 334 | 440 | 68.4 | - | - |
| 37 | 19 | 358 | 434 | 69.4 | - | - |
| Average | | 345 | 439 | 69.2 | | |
| Standard Deviation | | 12.2 | 5.0 | 0.7 | | |

Signed and Sealed this

Fourteenth Day of June, 1994

Bruce Lehman

BRUCE LEHMAN

*Commissioner of Patents and Trademarks*

*Attest:*

*Attesting Officer*